US010700468B2

(12) United States Patent
Wang et al.

(10) Patent No.: US 10,700,468 B2
(45) Date of Patent: Jun. 30, 2020

(54) CONNECTOR

(71) Applicant: SHENZHEN SHENTAI WEIXIANG ELECTRONICS CO., LTD., Shenzhen (CN)

(72) Inventors: Jian Wang, Shenzhen (CN); Ping Chen, Shenzhen (CN); Jun Wang, Shenzhen (CN)

(73) Assignee: SHENZHEN SHENTAI WEIXIANG ELECTRONICS CO., LTD., Shenzhen (CN)

( * ) Notice: Subject to any disclaimer, the term of this patent is extended or adjusted under 35 U.S.C. 154(b) by 0 days.

(21) Appl. No.: 16/405,853

(22) Filed: May 7, 2019

(65) Prior Publication Data

US 2020/0169028 A1 May 28, 2020

(30) Foreign Application Priority Data

Nov. 23, 2018 (CN) ..... 2018 1 1407824

(51) Int. Cl.

| | |
|---|---|
| ***H01R 13/50*** | (2006.01) |
| ***H01R 13/506*** | (2006.01) |
| ***H01R 13/631*** | (2006.01) |
| ***H01R 13/422*** | (2006.01) |
| ***H01R 13/533*** | (2006.01) |

(Continued)

(52) U.S. Cl.

CPC ..... *H01R 13/506* (2013.01); *H01R 13/422* (2013.01); *H01R 13/533* (2013.01); *H01R 13/631* (2013.01); *H01R 12/585* (2013.01); *H01R 12/712* (2013.01)

(58) Field of Classification Search

CPC .. H01R 13/506; H01R 13/422; H01R 13/533; H01R 13/631

USPC ..... 439/374

See application file for complete search history.

(56) References Cited

U.S. PATENT DOCUMENTS 5,603,638 A * 2/1997 Brown ..... H01R 24/22 439/106
6,500,025 B1 * 12/2002 Moenkhaus ..... H01R 27/00 439/218
6,575,776 B1 6/2003 Conner et al.

(Continued)

FOREIGN PATENT DOCUMENTS

WO 2008039464 A1 4/2008

OTHER PUBLICATIONS

The Extended European Search Report issued by EPO dated Feb. 14, 2020 for the corresponding EP patent application.

*Primary Examiner* — Alexander Gilman
(74) *Attorney, Agent, or Firm* — Platinum Intellectual Property LLP

(57) ABSTRACT

The present disclosure relates to a connector, including a connecting rod, a first female receptacle and a second female receptacle located on both sides of the connecting rod. The connecting rod includes a connecting rod body and a connecting rod terminal, the connecting rod body has a first latching groove and a second latching groove, and the connecting rod body is further provided with a plugging hole and an intermediate vent hole, the plugging hole is in communication with the first latching groove and the second latching groove, the connecting rod terminal extends through the plugging hole, and the intermediate vent hole is in communication with the first latching groove and the second latching groove.

20 Claims, 14 Drawing Sheets

(51) Int. Cl.
*H01R 12/58* (2011.01)
*H01R 12/71* (2011.01)

(56) References Cited

U.S. PATENT DOCUMENTS 6,663,422 B1 * 12/2003 Robinson ..... H01R 33/945 361/666
7,220,137 B1 * 5/2007 Liu ..... H01R 13/447 220/375
7,938,675 B1 5/2011 Yu et al.
7,976,332 B2 * 7/2011 Matsumura ..... H01R 13/629 439/374
8,212,145 B2 * 7/2012 Nagai ..... B60R 16/0239 174/59
8,398,425 B2 * 3/2013 Suzuki ..... H01R 12/716 439/374
8,517,772 B2 * 8/2013 Wu ..... H01R 24/62 439/501
8,647,143 B2 * 2/2014 Kodama ..... H01R 12/7082 439/374
9,362,765 B1 * 6/2016 Blaszczak ..... H01R 31/065
9,876,317 B2 * 1/2018 Glick ..... H01R 31/06
9,966,716 B2 * 5/2018 Soohoo ..... H01R 13/652
2007/0197057 A1 * 8/2007 Wu ..... H01R 31/06 439/76.1
2008/0096435 A1 * 4/2008 Mills ..... H01R 25/00 439/668
2012/0156909 A1 * 6/2012 Tyler ..... H01R 13/112 439/259
2016/0056583 A1 * 2/2016 Chuang ..... H01R 43/24 439/607.01
2017/0373413 A1 12/2017 Wang

* cited by examiner

CONNECTOR

CROSS-REFERENCE TO RELATED APPLICATION

This application claims the benefit of Chinese Patent Application No. 2018114078245, filed on Nov. 23, 2018, the entire content of which is incorporated herein in its entirety.

TECHNICAL FIELD

The present disclosure is related to electric products, and particularly relates to a connector.

BACKGROUND

A connector is an indispensable part of an electronic device. The function of a connector is to bridge the conduction of an electrical signal between two circuits that are blocked or isolated, for conducting transmission of a current or signal. The tolerance of a conventional connector is poor, such that the convenience of use of the connector is poor. In addition, the conductive sheet of the conventional connector is received in the base, and the connector can only exchange heat with the outside air through the casing or the conductive sheet exposed outside of the casing, such that the heat accumulation during use of the connector is severe, resulting in a lower service life of the connector.

SUMMARY

According to various embodiments of present disclosure, a connector is provided.

A connector includes a connecting rod, a first female receptacle, and a second female receptacle. The connecting rod includes a connecting rod body and a connecting rod terminal. The connecting rod body is provided with a first latching groove and a second latching groove, and the connecting rod body is further provided with a plugging hole and an intermediate vent hole, the plugging hole is in communication with the first latching groove and the second latching groove, respectively, the connecting rod terminal extends through the plugging hole, and the intermediate vent hole is in communication with the first latching groove and the second latching groove, respectively. The first female receptacle includes a first receptacle body located in the first latching groove and a first conductive terminal. The first receptacle body is provided with a first mounting groove and a first vent hole both in communication with the first latching groove, the first conductive terminal is latched into the first mounting groove, and an end of the connecting rod terminal is located in the first mounting groove and is slidably connected to the first conductive terminal. The second female receptacle includes a second receptacle body located in the second latching groove and a second conductive terminal. The second receptacle body is provided with a second mounting groove and a second vent hole both in communication with the second latching groove, the second conductive terminal is latched into the second mounting groove, and another end of the connecting rod terminal is located in the second mounting groove and is slidably connected to the second conductive terminal. The connecting rod terminal slides in a first direction with respect to the first conductive terminal, and the connecting rod terminal slides in a second direction with respect to the second conductive terminal, the connecting rod terminal further slides in an axial direction of the connecting rod body with respect to the second conductive terminal, the axial direction of the connecting rod body, the first direction, and the second direction are mutually perpendicular to one another.

These and other objects, advantages, purposes and features will become apparent upon review of the following specification in conjunction with the drawings.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

DETAILED DESCRIPTION OF THE EMBODIMENTS

Embodiments of the present disclosure are described more fully hereinafter with reference to the accompanying drawings. A preferred embodiment is described in the accompanying drawings. The various embodiments of the present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art.

It will be understood that when an element is referred to as being "fixed" to another element, it can be directly fixed to the other element or intervening elements may be present. Also, when an element is referred to as being "connected" or "coupled" to another element, it can be directly connected or coupled to the other element or intervening elements may be present. As used herein, the terms "vertical", "horizontal", "left", "right" and the like are merely for the illustrative purpose.

Unless otherwise defined, all terms (including technical and scientific terms) used herein have the same meaning as commonly understood by one of ordinary skill in the art to which this invention belongs. The terms used herein is for the purpose of describing particular embodiments only and is not intended to limit the present disclosure. As used herein, the term "and/or" includes any and all combinations of one or more of the associated listed items.

Figure 1:
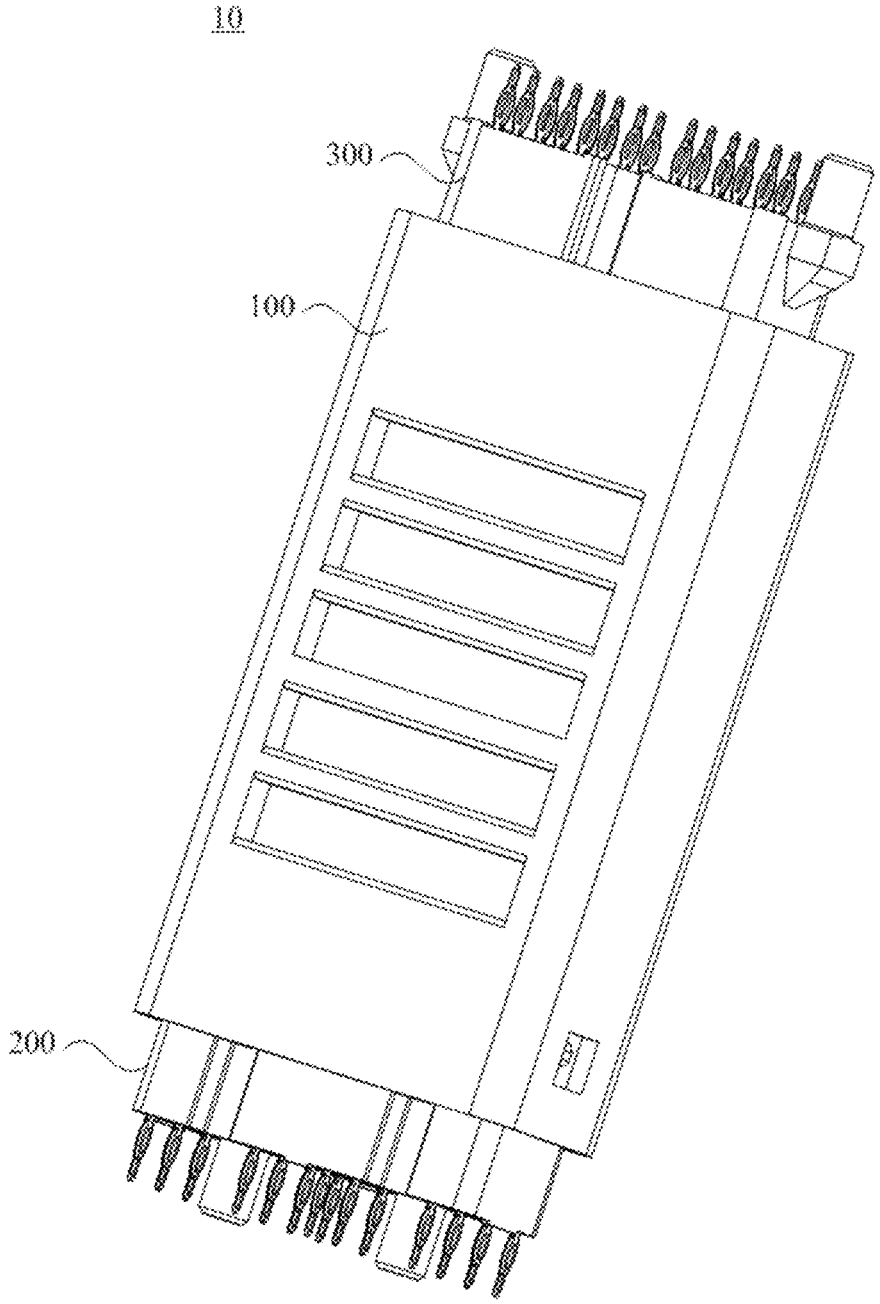
FIG. 1 is a perspective view of a connector according to an embodiment.

Referring to FIG. 1, a connector 10 according to an embodiment includes a connecting rod 100, a first female receptacle 200, and a second female receptacle 300, which are located on both sides of the connecting rod 100, respectively.

Figure 2:
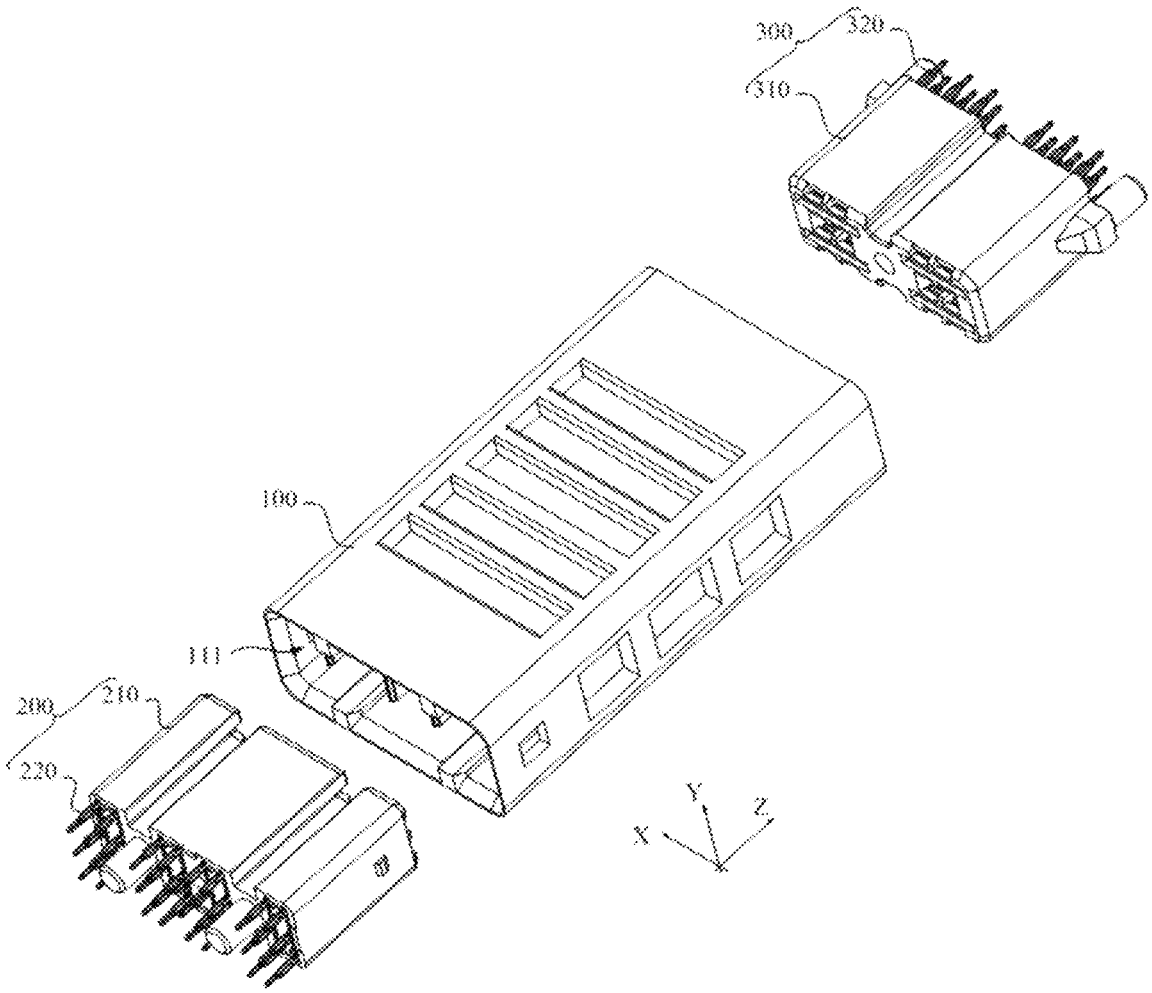
FIG. 2 is an exploded view of the connector in FIG. 1.
Figure 3:
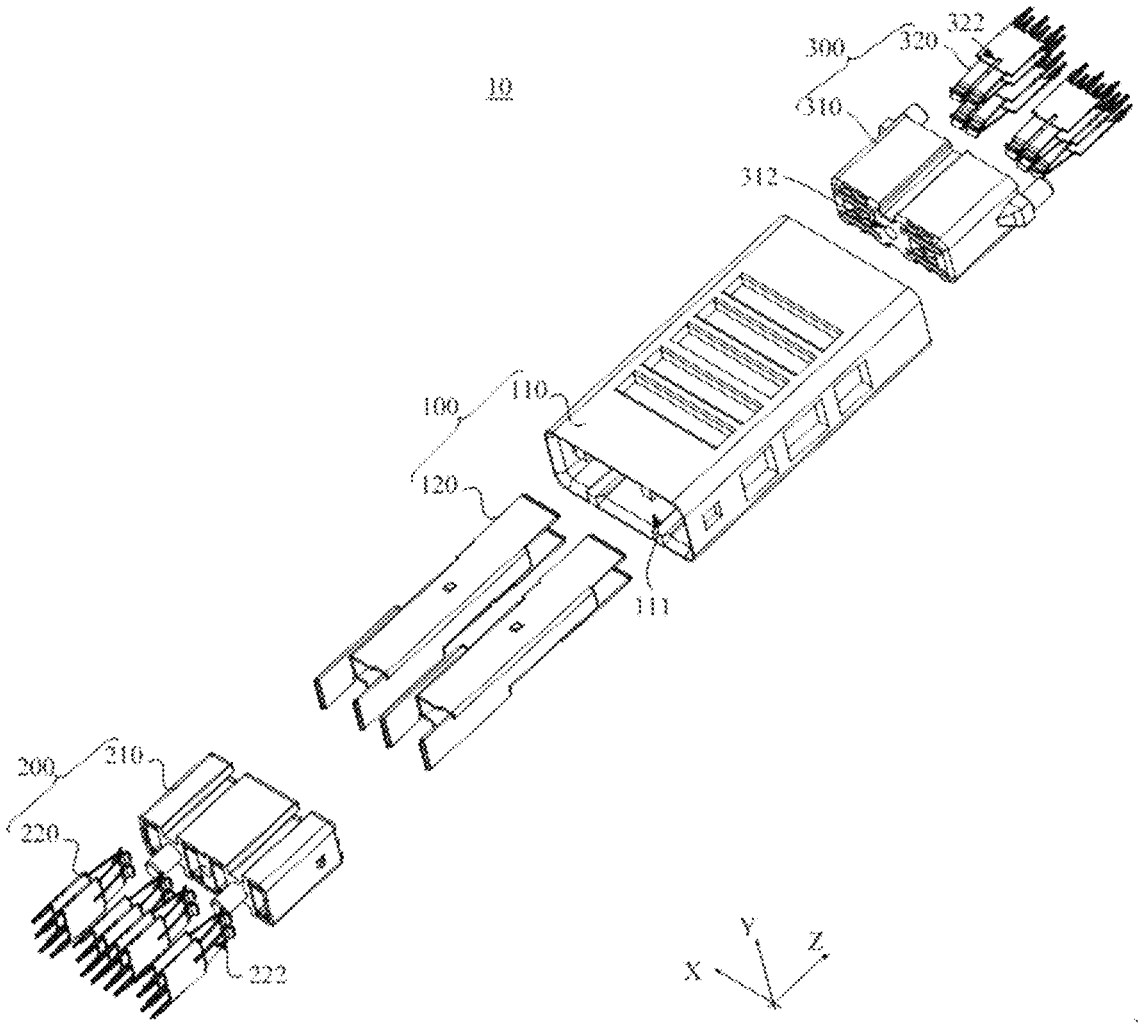
FIG. 3 is an exploded view of the connector in FIG. 2.

Referring to FIG. 2 and FIG. 3, in one of the embodiments, the connecting rod 100 includes a connecting rod body 110 and a connecting rod terminal 120. Also referring to FIG. 4, the connecting rod body 110 is provided with a first latching groove 111 and a second latching groove 112. In the illustrated embodiment, the connecting rod body 110 is substantially cuboid. The first latching groove 111 and the second latching groove 112 are provided on both ends of the connecting rod body 110, respectively. In alternative embodiments, the first latching groove 111 and the second latching groove 112 can also be provided on both sides of the connecting rod body 110, or on other positions. The connecting rod body 110 is further provided with a plugging hole 113 and an intermediate vent hole 114. The plugging hole 113 is in communication with the first latching groove 111 and the second latching groove 112, respectively, and the connecting rod terminal 120 extends through the plugging hole 113. The intermediate vent hole 114 is in communication with the first latching groove 111 and the second latching groove 112, respectively. In the illustrated embodiment, the first latching groove 111 and the second latching groove 112 are located on both ends the connecting rod body 110, respectively. The plugging hole 113 and the intermediate vent hole 114 both extending through the connecting rod body 110 along the axial direction thereof, such that the intermediate vent hole 114 is in communication with the first latching groove 111 and the second latching groove 112, and the plugging hole 113 is in communication with the first latching groove 111 and the second latching groove 112, respectively.

Figure 4:
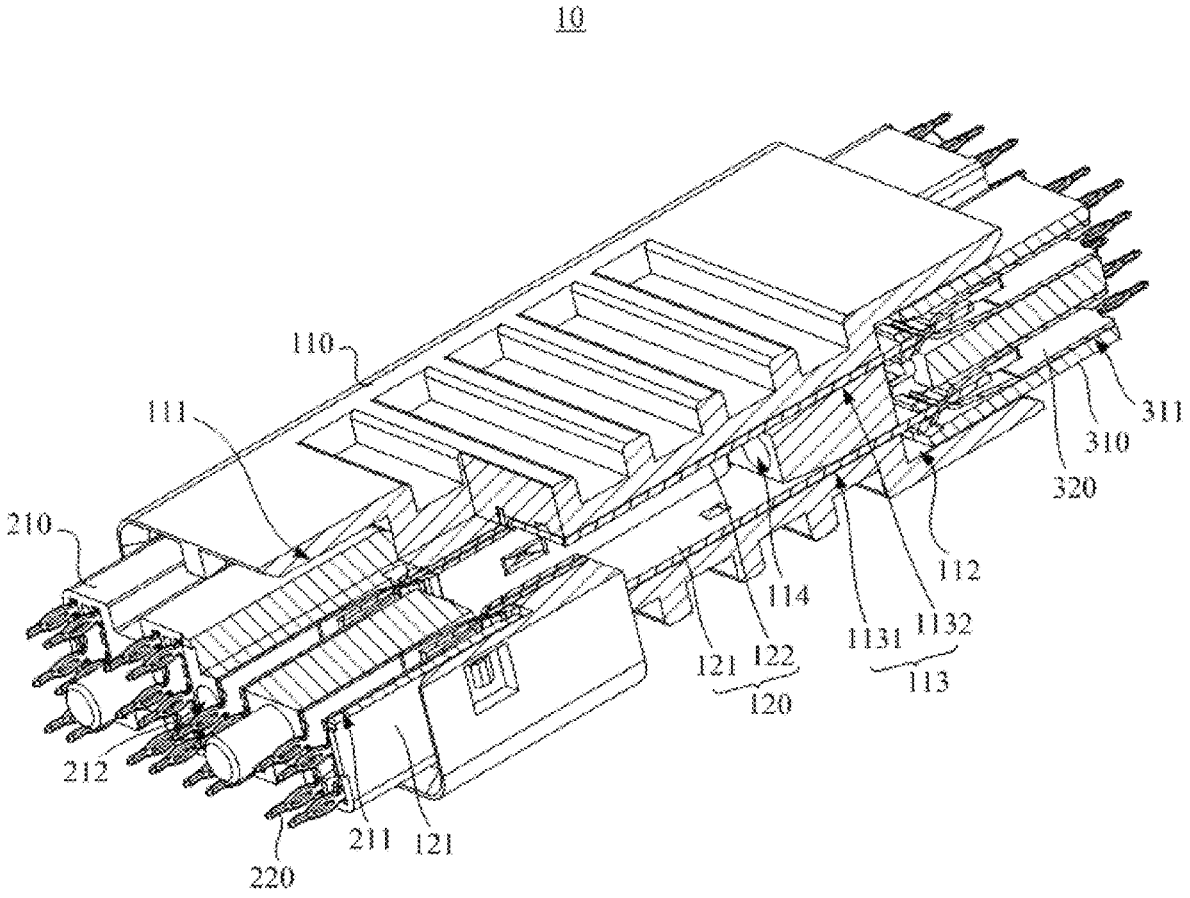
FIG. 4 is a cut-away view of the connector in FIG. 1.
Figure 5:
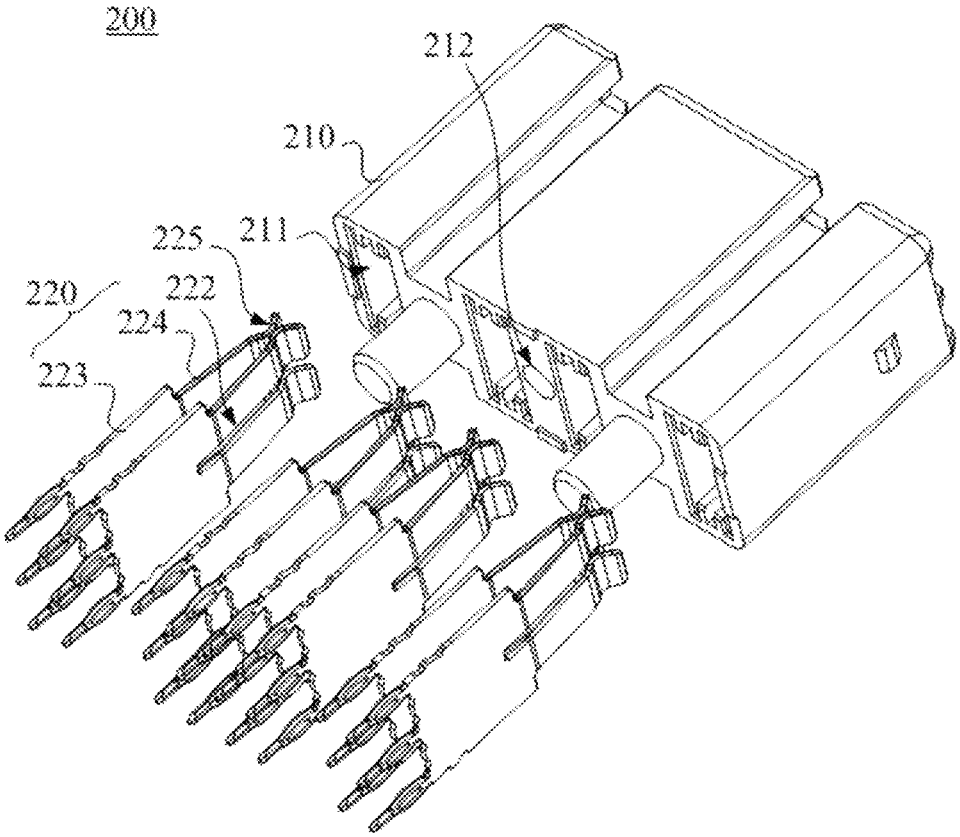
FIG. 5 is an exploded view of a first female receptacle of the connector in FIG. 1.
Figure 6:
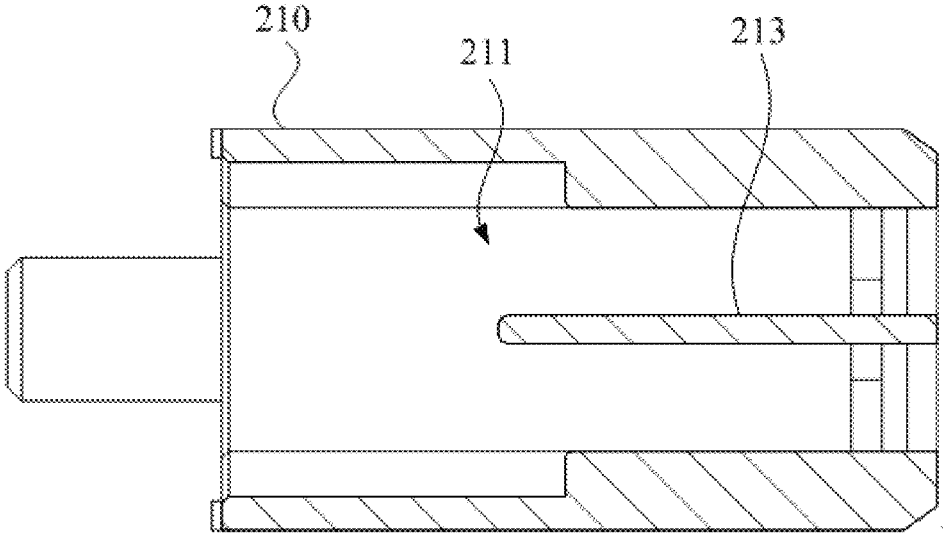
FIG. 6 is a cross-sectional view of a first receptacle body of the first female receptacle in FIG. 5.

As shown in FIG. 4 and FIG. 5, in one of the embodiments, the first female receptacle 200 includes a first receptacle body 210 and a first conductive terminal 220. The first receptacle body 210 is located in the first latching groove 111. In the illustrated embodiment, the first female receptacle 200 is located in the first latching groove 111. The first receptacle body 210 is in clearance engagement with the connecting rod body 110, and the first receptacle body 210 moves with respect to the connecting rod body 110. The first receptacle body 210 is provided with a first mounting groove 211 and a first vent hole 212 both in communication with the first latching groove 111. The first conductive terminal 220 is latched into the first mounting groove 211. An end of the connecting rod terminal 120 is further located in the first mounting groove 211 and is slidably connected to the first conductive terminal 220. Also referring to FIG. 6, in one of the embodiments, the first conductive terminal 220 is provided with a first latching slot 222, and the inner wall of the first mounting groove 211 is provided with a first latching rib 213 slidably received in the first latching slot 222, such that the first conductive terminal 220 can be latched into the first mounting groove 211.

Figure 7:
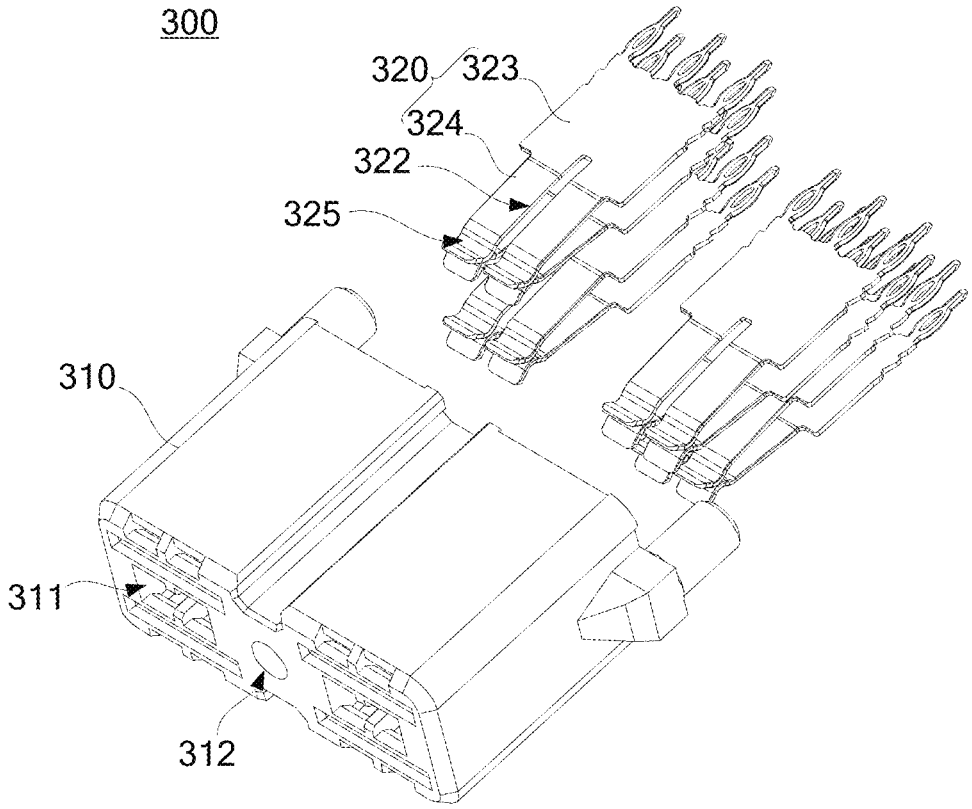
FIG. 7 is an exploded view of a second female receptacle in FIG. 1.

As shown in FIG. 4 and FIG. 7, in one of the embodiments, the second female receptacle 300 includes a second receptacle body 310 and a second conductive terminal 320. The second female receptacle 300 is located in the second latching groove 112. In the illustrated embodiment, the second female receptacle 300 is located in the second latching groove 112. The second receptacle body 310 is in clearance engagement with the connecting rod body 110, and the second receptacle body 310 moves with respective to the connecting rod body 110. The second receptacle body 310 is provided with a second mounting groove 311 and a second vent hole 312 both in communication with the second latching groove 112. The second conductive terminal 320 is latched into the second mounting groove 311. Another end of the connecting rod terminal 120 is further located in the second mounting groove 311 and is slidably connected to the second conductive terminal 320. In one of the embodiments, the second conductive terminal 320 is provided with a second latching slot 322, and the inner wall of the second mounting groove 211 is provided with a second latching rib slidably received in the second latching slot 322, such that the second conductive terminal 320 can be latched into the second mounting groove 211.

The connecting rod terminal 120 slides in a first direction with respect to the first conductive terminal 220, and the connecting rod terminal 120 slides in a second direction with respect to the second conductive terminal 320, the connecting rod terminal 120 further slides in an axial direction of the connecting rod body 110 with respect to the second conductive terminal 320. The axial direction of the connecting rod body 110, the first direction, and the second direction are mutually perpendicular to one another. In the illustrated embodiment, the directions in which the connecting rod terminal 120 slides with respect to the second conductive terminal 320 are the second direction and the axial direction of the connecting rod body 110, and the second direction and the axial direction of the connecting rod body 110 are perpendicular to each other. The first direction is parallel to a side of the end surface of the connecting rod body 110, the second direction is parallel to another side of the end surface of the connecting rod body 110, and the first direction and the second direction are perpendicular to each other. As shown in FIG. 3, the first direction is the direction of axis X, the second direction is the direction of axis Y, and the axial direction of the connecting rod body 110 is the direction of axis Z.

In the aforementioned connector 10, the first receptacle body 210 is located in the first latching groove 111, and the second receptacle body 310 is located in the second latching groove 112. The first conductive terminal 220 is latched into the first mounting groove 211 and is slidably connected to the connecting rod terminal 120, such that the first receptacle body 210 can slide with respect to the first conductive terminal 220. The second conductive terminal 320 is latched into the second mounting groove 311 and is slidably connected to the connecting rod terminal 120, such that the second receptacle body 310 can slide with respective to the second conductive terminal 320. Since the connecting rod body 110, the first direction, and the second direction are perpendicular to one another, the sliding direction of the first receptacle body 210 with respect to the connecting rod body 110 is different from the sliding direction of the second receptacle body 310 with respect to the connecting rod body 110, such that the tolerance of the connector 10 is improved, and the use of the connector 10 becomes convenient. Since the connecting rod body 110 is provided with the intermediate vent hole 114, the first receptacle body 210 is provided with a first vent hole 212 in communication with the first latching groove 111, and the second receptacle body 310 is provided with a second vent hole 312 in communication with the second latching groove 112, and the intermediate vent hole 114 is in communication with the first latching groove 111 and the second latching groove 112, such that the intermediate vent hole 114 is in communication with the first vent hole 212 and the second vent hole 312, thereby communicating the first vent hole 212 with the second vent hole 312 through the intermediate vent hole 114.

The air around the connector 10 can enter the first latching groove 111 through the first vent hole 212, and can be discharged through the intermediate vent hole 114, the second latching groove 112, and the second vent hole 312, such that the air can flow through the connector 10. The plugging hole 113 is in communication with the first latching groove 111 and the second latching groove 112, the first mounting groove 211 is in communication with the first latching groove 111, and the second mounting groove 311 is in communication with the second latching groove 112, such that the air entering the first latching groove 111 can dissipate heat from the first conductive terminal 220 and the connecting rod terminal 120, and the air entering the second latching groove 112 can dissipate heat from the second conductive terminal 320 and the connecting rod terminal 120, such that the air can perform heat exchange not only around the connector 10 but also inside the connector 10. The air around the connector 10 can also enter the second latching groove 112 through the second vent hole 312, and is discharged through the intermediate vent hole 114, the first latching groove 111 and the first vent hole 212. Similarly, the air entering the first latching groove 111 can dissipate heat from the first conductive terminal 220 and the connecting rod terminal 120, and the air entering the second latching groove 112 can dissipate heat from the second conductive terminal 320 and the connecting rod terminal 120, such that the air can perform heat exchange not only around the connector 10 but also inside the connector 10. The aforementioned connector 10 not only has better tolerance, but also has a better heat dissipation effect.

In one of the embodiments, the displacement of the connecting rod terminal 120 to slide in the first direction with respect to the first conductive terminal 220 is −0.5 mm to −0.5 mm, such that a deviation of ±0.5 mm in the first direction is allowed between the connecting rod terminal 120 and the first receptacle body 210, that is, a tolerance of ±0.5 mm in the first direction is achieved between the connecting rod terminal 120 and the first receptacle body 210.

In one of the embodiments, the displacement of the connecting rod terminal 120 to slide in the second direction with respect to the second conductive terminal 320 is −0.5 mm to −0.5 mm, such that a deviation of ±0.5 mm in the second direction is allowed between the connecting rod terminal 120 and the second receptacle body 310, that is, a tolerance of ±0.5 mm in the second direction is achieved between the connecting rod terminal 120 and the second receptacle body 310.

In one of the embodiments, the displacement of the connecting rod terminal 120 to slide in the axial direction of the connecting rod body 110 with respect to the second conductive terminal 320 is −1.2 mm to −1.2 mm, such that a deviation of ±1.2 mm in the axial direction of the connecting rod body 110 is allowed between the connecting rod terminal 120 and the second receptacle body 310, that is, a tolerance of ±1.2 mm in the axial direction of the connecting rod body 110 is achieved between the connecting rod terminal 120 and the second receptacle body 310.

As shown in FIG. 4, in one of the embodiments, both ends of the connecting rod terminal 120 are received in the first latching groove 111 and the second latching groove 112, respectively, such that both ends of the connecting rod terminal 120 are slidably connected to the first conductive terminal 220 and the second conductive terminal 320, respectively.

Figure 8:
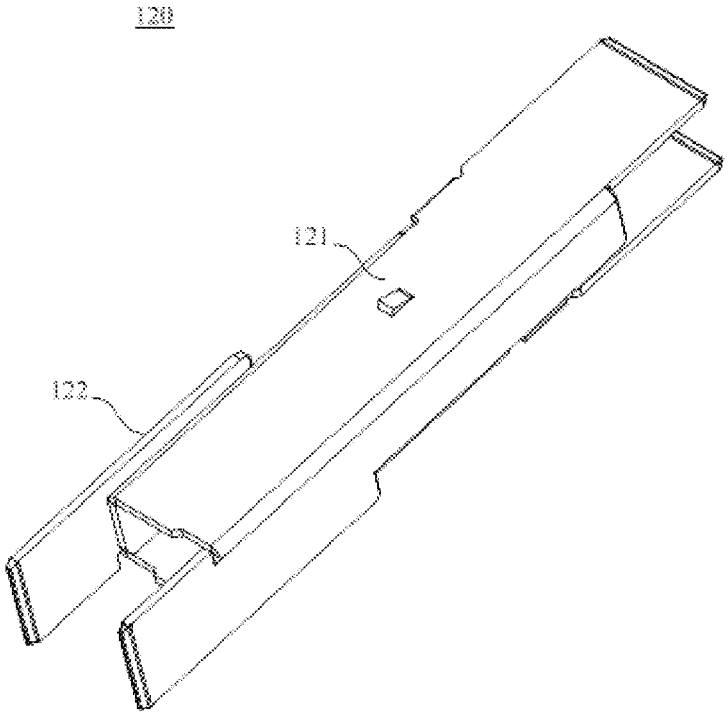
FIG. 8 is a perspective view of a connecting rod terminal in FIG. 1.

As shown in FIG. 8, in one of the embodiments, the connecting rod terminal 120 includes a first terminal unit 121 and a second terminal unit 122 electrically coupled to each other. Also referring to FIG. 4, the plugging hole 113 includes a first plugging hole 1131 and a second plugging hole 1132. The first plugging hole 1131 is in communication with the first latching groove 111 and the second latching groove 112, the second plugging hole 1132 is in communication with the first latching groove 111 and the second latching groove 112. The first terminal unit 121 extends through the first plugging hole 1131, and the second terminal unit 122 extends through the second plugging hole 1132.

In one of the embodiments, the number of the first conductive terminal 220 is at least two. The number of the first mounting groove 211 is at least two, and each of the first conductive terminals 220 is located in the corresponding first mounting grooves 211. The number of the second conductive terminal 320 is at least two. The number of the second mounting groove 311 is at least two, and each of the second conductive terminals 320 is located in the corresponding second mounting grooves 311.

In one of the embodiments, both ends of each of the first terminal units 121 are located in one of the first mounting grooves 211 and one of the second mounting grooves 311, respectively. Both ends of each of the first terminal units 121 are slidably connected to the corresponding first conductive terminal 220 and the corresponding second conductive terminal, respectively 320. Both ends of each of the second terminal units 122 are located in another one of the first mounting grooves 211 and another of the second mounting grooves 311, respectively. Both ends of each of the second terminal units 122 are slidably connected to the corresponding first conductive terminal 220 and the corresponding second conductive terminal 320, respectively. Since the first terminal units 121 are electrically coupled to the second terminal units 122, and both ends of each of the first terminal units 121 are connected to the first conductive terminal 220 and the second conductive terminal 320, both ends of each of the second terminal units 122 are connected to the first conductive terminal 220 and the second conductive terminal 320, such that both ends of the connecting rod terminal 120 can be slidably connected to two first terminal units 121 and two second terminal units 122.

In one of the embodiments, one end of the first terminal unit 121 is slidably connected to two first conductive terminals 220 and the another end is slidably connected to two second conductive terminals 320. The first terminal unit 121 and the two first conductive terminals 220 are located in one of the first mounting grooves 211, and the two second conductive terminals 320 and the second terminal unit 122 are located in one of the second mounting grooves 311, such that both ends of the first terminal unit 121 can slide with respect to the first conductive terminal 220 and the second conductive terminal 320.

In the illustrated embodiment, the two first conductive terminals 220 located in the same first mounting groove 211 abut against both sides of the first terminal unit 121, respectively, such that the two first conductive terminals 220 are clamped by both sides of the first terminal unit 121. In one of the embodiments, the two first conductive terminals 220 located in the same first mounting groove 211 elastically abut against both sides of the first terminal unit 121, respectively, thereby allowing the two first conductive terminals 220 to clamp both sides of the first terminal unit 121. The two second conductive terminals 320 located in the same second mounting groove 311 abut against both sides of the second terminal unit 122, respectively, such that the two second conductive terminals 320 clamp both sides of the second terminal unit 122. In one of the embodiments, the two second conductive terminals 320 located in the second first mounting groove 311 elastically abut against both sides of the second terminal unit 122, respectively, thereby allowing the two second conductive terminals 320 to clamp both sides of the second terminal unit 122.

In one of the embodiments, one end of the second terminal unit 122 is slidably connected to two first conductive terminals 220 and the another end of the second terminal unit 122 is slidably connected to two second conductive terminals 320. The second terminal unit 122 and the two first conductive terminals 320 are located in another of the first mounting grooves 211, and the two second conductive terminals 320 and the second terminal unit 122 are located in another of the second mounting grooves 311, such that both ends of the second terminal unit 122 can slide with respect to the first conductive terminal 220 and the second conductive terminal 320.

In the illustrated embodiment, the two first conductive terminals 220 located in the same first mounting groove 211 abut against both sides of the first terminal unit 121, respectively, such that the two first conductive terminals 220 clamp both sides of the first terminal unit 121. In one of the embodiments, the two first conductive terminals 220 located in the same first mounting groove 211 elastically abut against both sides of the first terminal unit 121, respectively, thereby allowing the two first conductive terminals 220 to clamp both sides of the first terminal unit 121. The two second conductive terminals 320 located in the same second mounting groove 311 abut against both sides of the second terminal unit 122, respectively, such that the two second conductive terminals 320 clamp both sides of the second terminal unit 122. In one of the embodiments, the two second conductive terminals 320 located in the second mounting groove 311 elastically abut against both sides of the second terminal unit 122, respectively, thereby allowing the two second conductive terminals 320 to clamp both sides of the second terminal unit 122.

As shown in FIG. 4 and FIG. 5, in one of the embodiments, the two first conductive terminals 220, which are respectively slidably connected to the second terminal unit 122, are bent in a direction closer to each other, such that the two first conductive terminals 220 can abut against the first terminal unit 121. Also referring to FIG. 7, the two second conductive terminals 320, which are respectively slidably connected to the second terminal unit 122, are bent in a direction closer to each other, such that the two second conductive terminals 320 can abut against the second terminal unit 122. In the illustrated embodiment, the two first conductive terminals 220 located in the same first mounting groove 211 are respectively abut against both sides of the second terminal unit 122, and the two second conductive terminals 320 located in the same second mounting groove 311 are respectively abut against both sides of the second terminal unit 122.

As shown in FIG. 5, in one of the embodiments, each of the first conductive terminals 220 includes a first body portion 223 and a first bending portion 224 connected to each other. A first bending cavity 225 is formed on the first bending portion 224, and the first bending cavity 255 of each of the first conductive terminals 220 is positioned on a side of the first bending portion 224 away from the second terminal unit 122 since both the first conductive terminals 220 slidably connected to the second terminal unit 122 are bent in a direction closer to each other. As shown in FIG. 7, in one of the embodiments, each of the second conductive terminals 320 includes a second body portion 323 and a second bending portion 324 connected to each other. A second bending cavity 325 is formed on the second bending portion 324, and the second bending cavity 255 of each of the second conductive terminals 220 is positioned on a side of the second bending portion 324 away from the second terminal unit 122 since both the second conductive terminals 220 slidably connected to the second terminal unit 122 are bent in a direction closer to each other.

In other embodiments, the two first conductive terminals 220, which are respectively slidably connected to the second terminal unit 122, can also be bent in a direction away from each other, such that the two first conductive terminals 220 can abut against the first terminal unit 121, respectively. The two second conductive terminals 320, which are respectively slidably connected to the second terminal unit 122, are bent in a direction away from each other, such that the two second conductive terminals 320 can abut against the second terminal unit 122, respectively. In the embodiment, the bending cavity of each of the first conductive terminals 220 is located on a side thereof adjacent to the second terminal unit 122, and the bending cavity of each of the second conductive terminals 320 is located on a side thereof adjacent to the second terminal unit 122.

In other embodiments, the two first conductive terminals 220, which are respectively slidably connected to the first terminal unit 121, are bent in a direction closer to each other, such that the two first conductive terminals 220 can abut against the first terminal unit 121. The two second conductive terminals 320, which are respectively slidably connected to the first terminal unit 121, are bent in a direction closer to each other, such that the two second conductive terminals 320 can abut against the first terminal unit 121. In the embodiment, the two first conductive terminals 220 located in the same first mounting groove 211 are respectively abut against both sides of the first terminal unit 121, and the two second conductive terminals 320 located in the same second mounting groove 311 are respectively abut against both sides of the first terminal unit 121. Since both of the first conductive terminal 220 slidably connected to the first terminal unit 121 are bent closer to each other, the first bending cavity 225 of each of the first conductive terminal 220 is located on a side thereof away from the first terminal unit 121. Similarly, since both of the second conductive terminal 320 slidably connected to the first terminal unit 121 are bent closer to each other, the second bending cavity 325 of each of the second conductive terminal 320 is located on a side thereof away from the first terminal unit 121.

In other embodiments, the two first conductive terminals 220, which are respectively slidably connected to the first terminal unit 121, can also be bent in a direction away from each other, such that the two first conductive terminals 220 can abut against the first terminal unit 121, respectively. The two second conductive terminals 320, which are respectively slidably connected to the first terminal unit 121, are bent in a direction away from each other, such that the two second conductive terminals 320 can abut against the first terminal unit 121, respectively. In the embodiment, the bending cavity 225 of each of the first conductive terminals 220 is located on a side thereof adjacent to the first terminal unit 121, and the bending cavity 325 of each of the second conductive terminals 320 is located on a side thereof adjacent to the first terminal unit 121.

As shown in FIG. 4 and FIG. 8, in one of the embodiments, the first terminal unit 121 abuts against the second terminal unit 122, so as to electrically couple the first terminal unit 121 to the second terminal unit 122. In the embodiment, both the first terminal unit 121 and the second terminal unit 122 are bent. The planes where the two ends of the first terminal unit 121 located are perpendicular to each other, such that both ends of the first terminal unit 121 are slidably connected to the first conductive terminal 220 and the second conductive terminal 320 on two different planes, respectively. The planes where the two ends of the second terminal unit 122 located are perpendicular to each other, such that both ends of the second terminal unit 122 are slidably connected to the first conductive terminal 220 and the second conductive terminal 320 on two different planes, respectively. Specifically, the plane where a first end of the first terminal unit 121 located is parallel to the plane where a first end of the second terminal unit 121 located, and the plane where a second end of the first terminal unit 121 located is parallel to the plane where a second end of the second terminal unit 122 located. The first plugging hole 1131 is in communication with the second plugging hole 1132.

Figure 9:
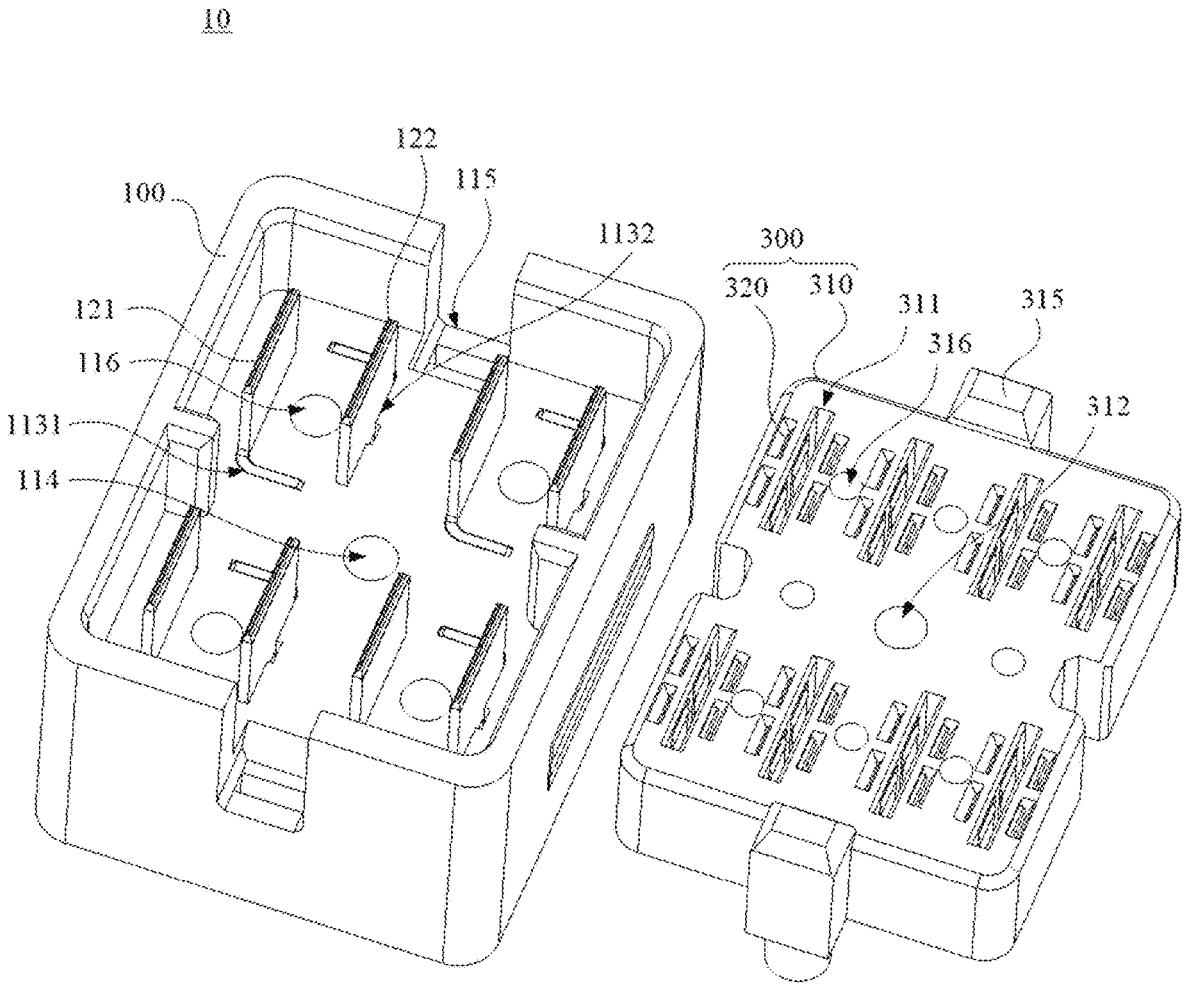
FIG. 9 is a perspective view of a connector according to another embodiment.

As shown in FIG. 9, in one of the embodiments, the connecting rod body 110 is further provided with a third vent hole 116 located between the first terminal unit 121 and the second terminal unit 122. The third vent hole 116 is in communication with the first latching groove 111 and the second latching groove 112, respectively, such that the air can enter the second latching groove 112 through the third vent hole 116, or enter the first latching groove 111 through the third vent hole 116, therefore the air can be dissipated through the third vent hole 116 in addition to the intermediate vent hole 114, increasing the rate of heat dissipation of the connector. Additionally, the first receptacle body 210 is further provided with a fourth vent hole (not shown in FIG. 9) in communication with the third vent hole 116, the second receptacle body 310 is further provided with a fifth vent hole 316 in communication with the third vent hole 116, such the external air can sequentially pass through the fourth vent hole, the third vent hole 116, and the fifth vent hole 316, such that the heat dissipation rate of the connector 10 is further improved.

In one of the embodiments, the first terminal unit 121 is provided with a protrusion, and the second terminal unit 122 is provided with a recess. The protrusion is latched into the recess, such that the first terminal unit 121 and the second terminal unit 122 is latched to each other, thereby realizing the quick assembly and disassembly of the first terminal unit 121 and the second terminal unit 122. It should be noted that, the first terminal unit 121 may also be welded to the second terminal unit 122, such that the first terminal unit 121 is securely connected to the second terminal unit 122.

Figure 10:
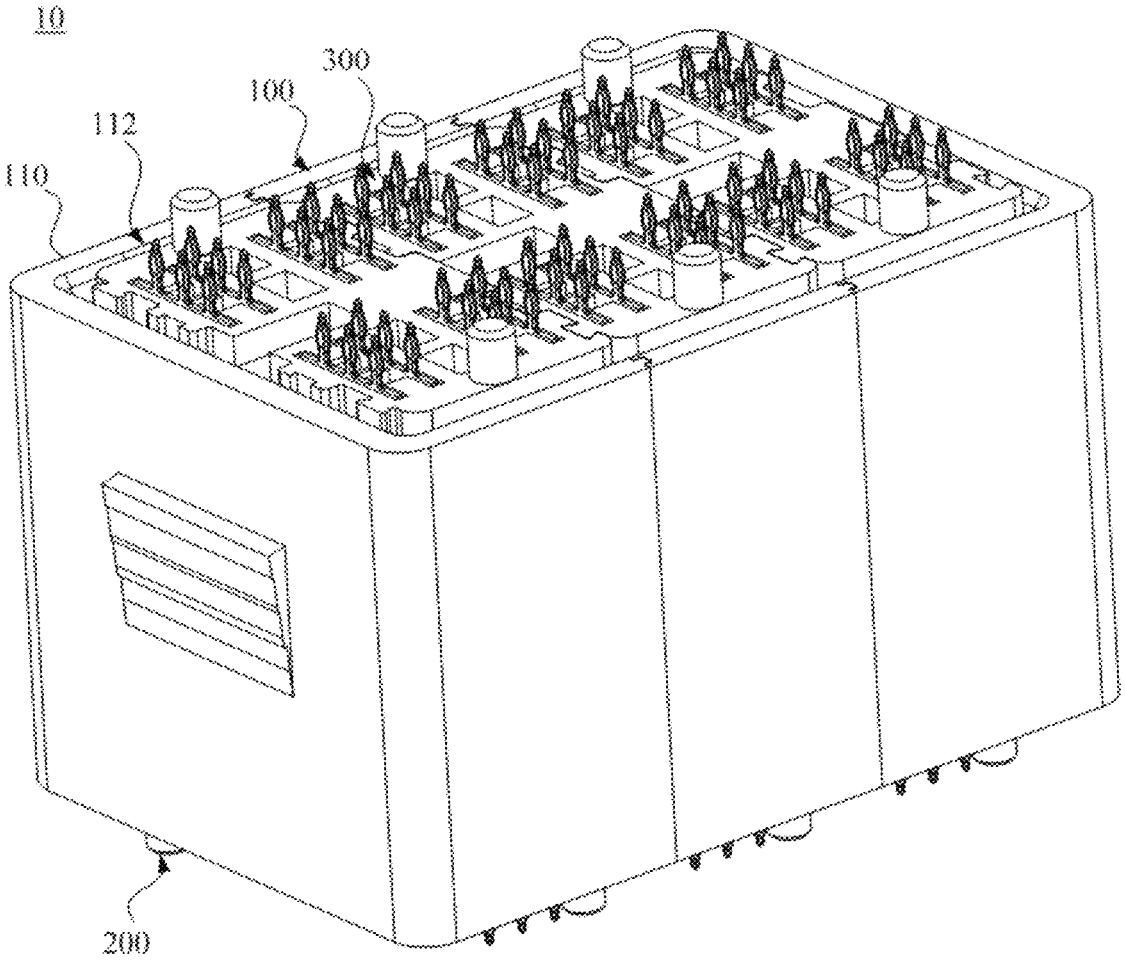
FIG. 10 is a perspective view of a connector according to yet another embodiment.
Figure 11:
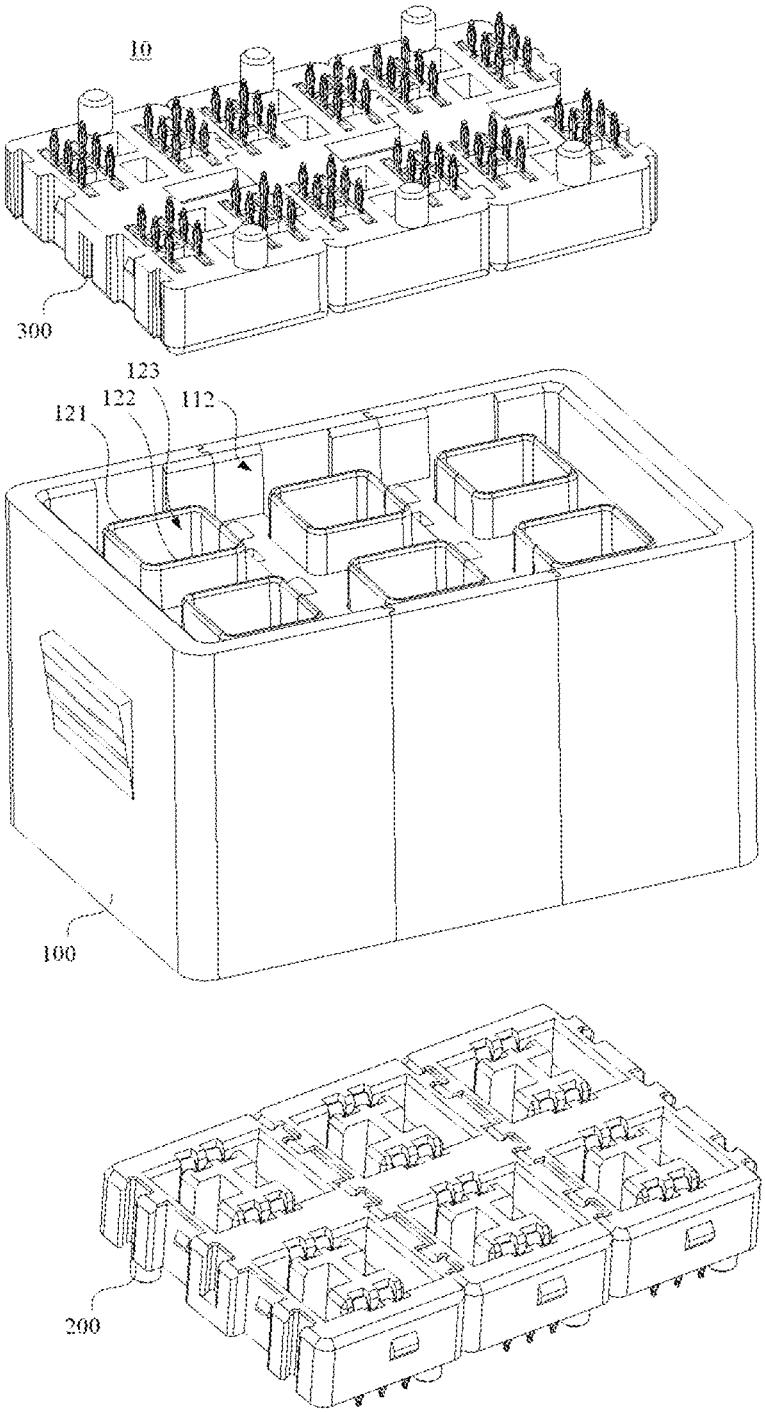
FIG. 11 is an exploded view of the connector in FIG. 10.
Figure 12:
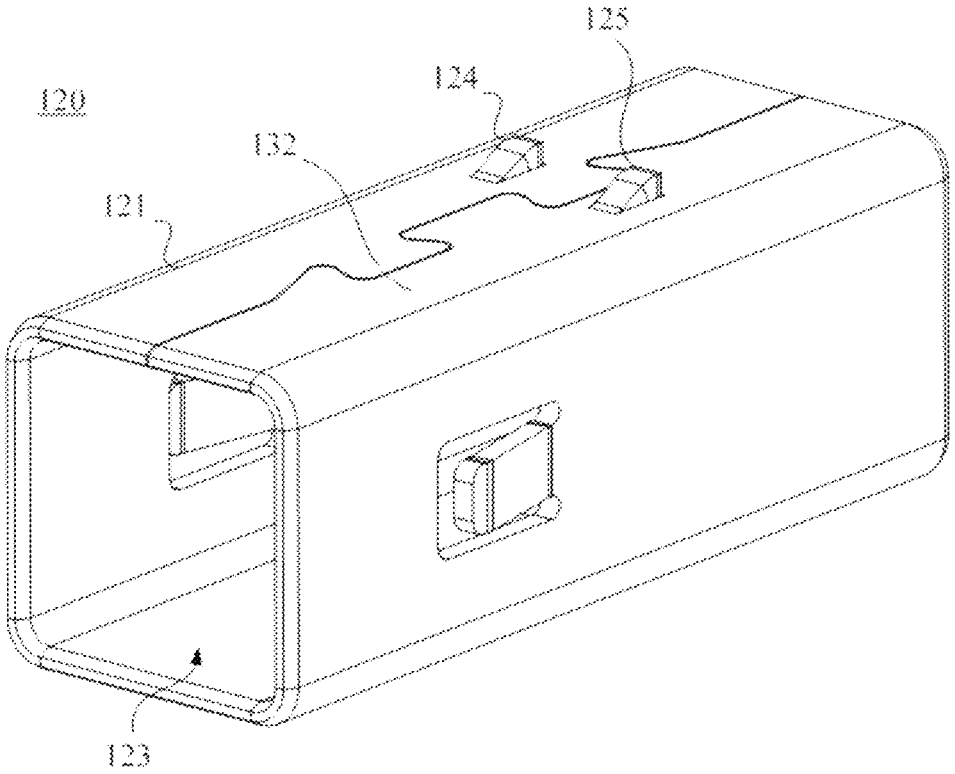
FIG. 12 is a perspective view of a connecting rod terminal in FIG. 10.
Figure 13:
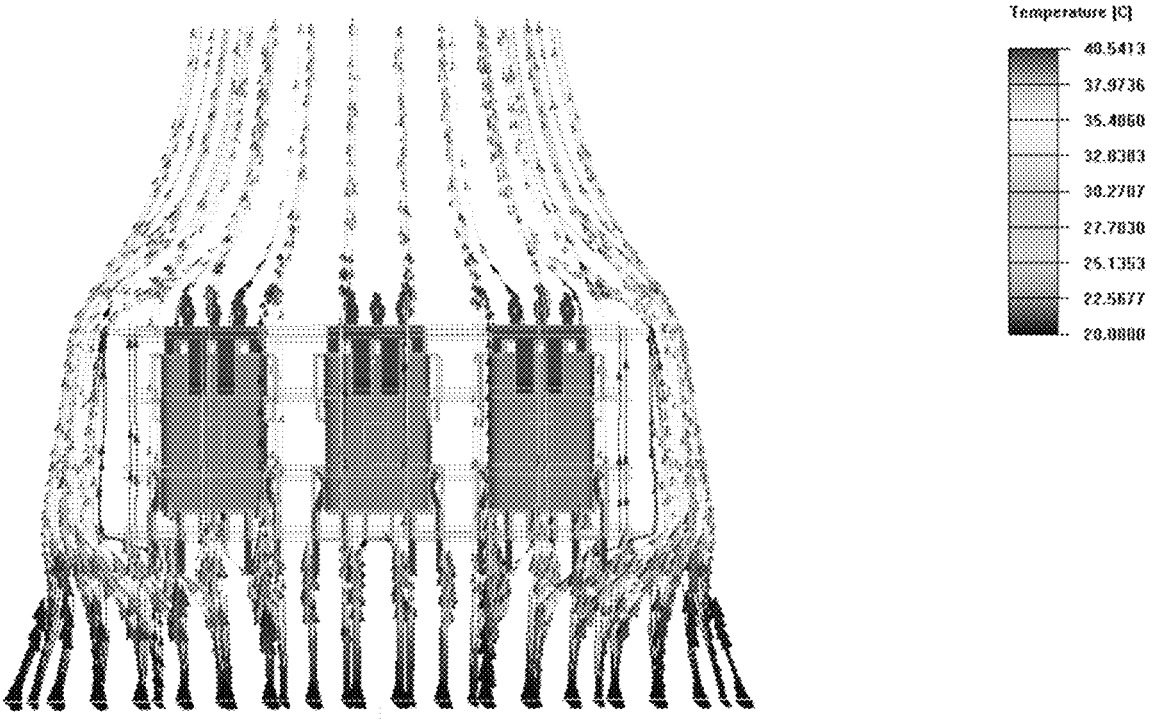
FIG. 13 is a diagram illustrating heat dissipation simulation of the connecting rod terminal in FIG. 10.

As shown in FIG. 10 to FIG. 12, in one of the embodiments, a vent chamber 123 is formed between the first terminal unit 121 and the second terminal unit 122. The vent chamber 123 is in communication with the first latching groove 111 and the second latching groove 112, such that the air entered the first vent hole 212 can also enter the second vent hole 312 through the vent chamber 123, or the air entered the second vent hole 312 can also enter the first vent hole 212 through the vent chamber 123. Therefore, the air entered the connector 10 can dissipate heat through the vent chamber 123 in addition to the intermediate ventilation hole 114, thereby improving the air circulation rate in the connector 10 and improving the heat dissipation performance of the connector 10. FIG. 13 is a schematic diagram of heat dissipation simulation of the connecting rod terminal 120 of the connector 10. As shown in FIG. 13, during the simulation test, the vent chamber 123 formed in the connecting rod terminal 120 can decrease the whole temperature of the connector 10 by 6° C. to 10° C. More heat in the connector 10 can be carried away by the air passing through the vent chamber 123 in the connecting rod terminal 120, which functions as the main heat dissipation channel in the connector 10, such that the connector 10 has a better heat dissipation effect. In this way, the connecting rod terminal 120 not only enhances the ventilation and heat dissipation, that is, the heat can be dissipated from the outside of the connecting rod terminal 120 in addition to the dissipating of the vent chamber 123 in the middle of the connecting rod terminal 123, but also achieves the sliding tolerance. In the illustrated embodiment, the first terminal unit 121 and the second terminal unit 122 cooperatively form a sleeve structure, and the sleeve structure has the vent chamber 123 therein. Specifically in the illustrated embodiment, the sleeve structure is a rectangular sleeve structure. The connecting rod terminal 120 is formed into a ring-shaped rectangular body structure, which can not only increase the heat dissipation effect of the connector 10, but also realize the orthogonal tolerance of the X and Y axial directions. In other embodiments, the shape of the sleeve structure can be adjusted and changed according to actual needs.

Figure 14:
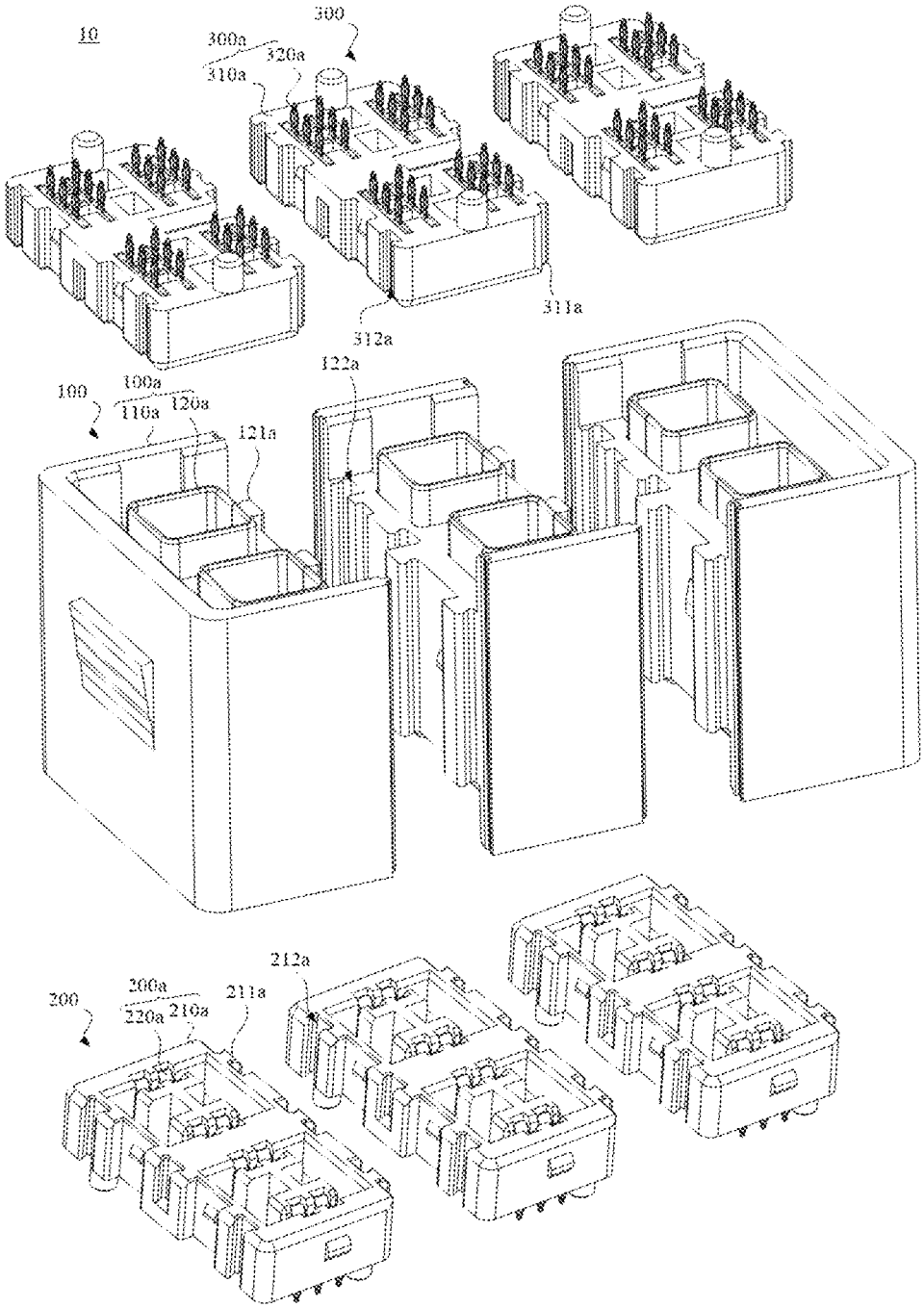
FIG. 14 is another exploded view of the connector in FIG. 10.

As shown in FIG. 12 and FIG. 14, in one of the embodiments, the first terminal unit 121 and the second terminal unit 122 is integrally formed, such that the connecting rod terminal 120 has a relatively compact structure and the manufacturing difficulty is low. In the illustrated embodiment, the first terminal unit 121 and the second terminal unit 122 are integrally formed by a bending process, such that the manufacturing cost of the connecting rod terminal 120 is relatively low.

As shown in FIG. 12, in one of the embodiments, the first terminal unit 121 is provided with a first elastic piece 124 abutting against an inner wall of the first plugging hole 1131, such that the first terminal unit 121 is tightly inserted into the first plugging hole 1131. The second terminal unit 122 is provided with a second elastic piece 125 abutting against an inner wall of the second plugging hole 1132, such that the second terminal unit 122 is tightly inserted into the second plugging hole 1132, thereby realizing the tightly assembly between the first terminal unit 121 and the second terminal unit 122.

As shown in FIG. 9, in one of the embodiments, the second receptacle body 310 is provided with a limiting boss 315, an end of the connecting rod body 110 adjacent to the second receptacle body 310 is provided with a sliding groove 115. The limiting boss 315 is located in the sliding groove 110 and slidably connected to the connecting rod body 110 and achieves a guiding effect, such that the connecting rod body 110 can well slide along the axial direction of the connecting rod body 110 with respect with the second conductive terminal 320.

In one of the embodiments, the plugging holes 113 are provided along the axial direction of the connecting rod body 110. In the illustrated embodiment, the first plugging hole 1131 and the second plugging hole 1132 are both provided along the axial direction of the connecting rod body 110, such that the first terminal unit 121 and second terminal unit 122 can be mounted along the axial direction of the connecting rod body 110.

Figure 15:
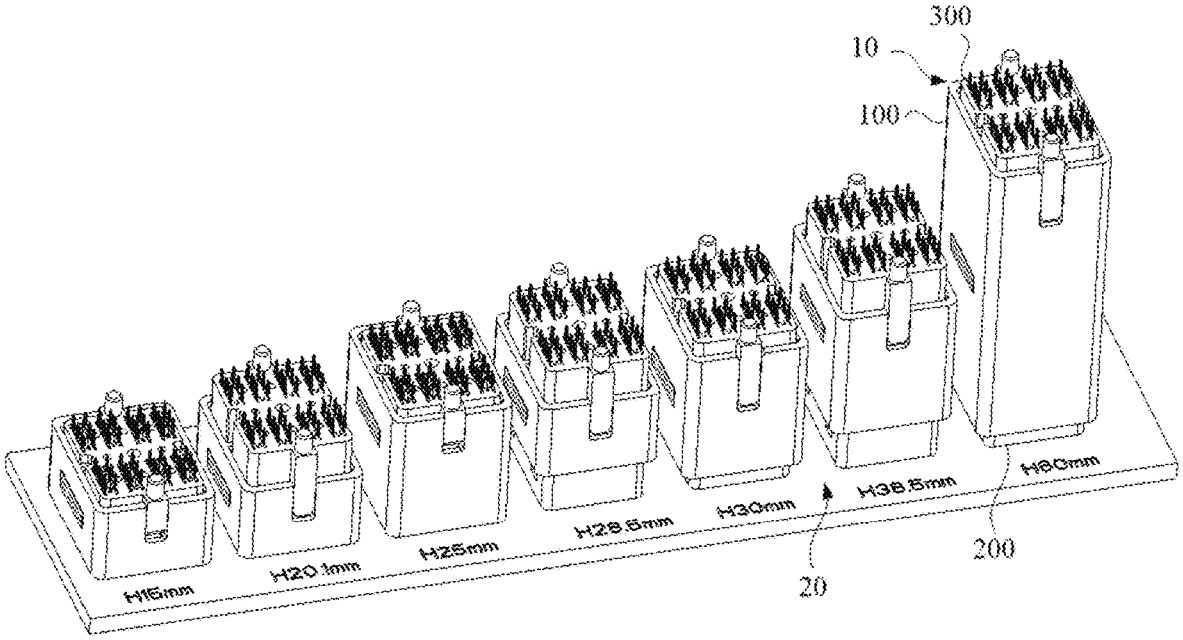
FIG. 15 is a perspective view showing connectors with different sizes mounted on a circuit board.

It should be noted that, the axial length of the connecting rod 100 can be adjusted according to different distances between the first female receptacle 200 and the second female receptacle 300. In this embodiment, the first female receptacle 200 and the second female receptacle 300 are respectively connected to two circuit boards. As shown in FIG. 15, the axial length of the connecting rod 100 is adjusted according to the different distance between the two circuit boards 20, and only one of the circuit boards 20 is shown in FIG. 15. According to different distances between the first female receptacle 200 and the second female receptacle 300, the connecting rods 100 can be adjusted into different axial lengths, and the axial lengths of the connecting rods 100 shown in FIG. 15 are 15 mm, 20.1 mm, 25 mm, 28.5 mm, 30 mm, 38.5 mm and 60 mm, etc.

In order to meet the requirements of different specifications, the number of horizontal or vertical channels of the connector 10 can be expanded. The connector 10 can be expanded from 1*2 Pin as shown in FIG. 2 to 1*4 Pin as shown in FIG. 14, 2*3 Pin and 2*4 Pin as shown in FIG. 11, or the like.

As shown in FIG. 14, in one of the embodiments, in order to facilitate the user to quickly assemble the connector 10 while achieving the expansion of the number of channels of the connector 10, the connecting rod 100 includes at least two connecting rod units 100*a*, and each of the connecting rod units 100*a* includes a connecting rod body unit 110*a* and a connecting rod terminal unit 120*a*. The connecting rod body units 110*a* of two adjacent connecting rod units 100*a* are slidably connected such that the adjacent connecting rod units 100*a* are slidably joined together. In the illustrated embodiment, a sliding connection between the connecting rod body units 110*a* of two adjacent connecting rod units 100*a* is realized by sliding cooperation between the connecting rod body units 110*a* of two adjacent connecting rod units 100*a* through a stage and a slot. Specifically, for the connecting rod body units 110*a* of two adjacent connecting rod units 100*a*, a first stage 121*a* is provided on the connecting rod body unit 120*a* of one connecting rod unit 100*a*, and a first slot 122*a* adapted to the first stage 121*a* is provided on the connecting rod body unit 110*a* of another connecting rod unit 100*a*, such that the connecting rod body units 110*a* of the two adjacent connecting rod units 100*a* are slidably engaged by the first stage 121*a* and the first slot 122*a*.

The first female receptacle 200 includes at least two first female receptacle units 200*a*, and each of the first female receptacle units 200*a* includes a first receptacle unit 210*a* and a first conductive terminal unit 220*a*. The first receptacle units 210*a* of the two first female receptacle units 200*a* adjacent to each other are slidably connected, such that the adjacent first female receptacle units 200*a* are slidably connected together. The first conductive terminal unit 220*a* of each of the first female receptacle units 200*a* is slidably connected to the connecting rod terminal unit 120*a* of the corresponding connecting rod unit 100*a*. In the illustrated embodiment, a sliding connection between the first receptacle units 210*a* of two adjacent first female receptacle units 200*a* is realized by sliding cooperation between the first receptacle units 210*a* of two adjacent first female receptacle units 200*a* through a stage and a slot. Specifically, for the first receptacle units 210*a* of two adjacent first female receptacle units 200*a*, a second stage 211*a* is provided on the first receptacle unit 210*a* of one first female receptacle unit 200*a*, and a second slot 212*a* adapted to the second stage 211*a* is provided on the first receptacle unit 210*a* of the another first female receptacle unit 200*a*, such that the first receptacle units 210*a* of two adjacent first female receptacle units 200*a* are slidably engaged by the stage and slot.

The second female receptacle 300 includes at least two second female receptacle units 300*a*, and each of the second female receptacle units 300*a* includes a second receptacle unit 310*a* and a second conductive terminal unit 320*a*. The second receptacle units 310*a* of the two second female receptacle units 300*a* adjacent to each other are slidably connected, such that the adjacent second female receptacle units 300*a* are slidably connected together. The second conductive terminal unit 320*a* of each of the second female receptacle units 300*a* is slidably connected to the connecting rod terminal unit 120*a* of the corresponding connecting rod unit 100*a*. In the illustrated embodiment, a sliding connection between the second receptacle units 310*a* of two adjacent second female receptacle units 300*a* is realized by sliding cooperation between the second receptacle units 310*a* of two adjacent second female receptacle units 300*a* through a stage and a slot. Specifically, for the second receptacle units 310*a* of two adjacent second receptacle units 300*a*, a second stage 311*a* is provided on the second receptacle unit 310*a* of one second female receptacle unit 300*a*, and a second slot 312*a* adapted to the third stage 311*a* is provided on the second receptacle unit 310*a* of the another second female receptacle unit 300*a*, such that the second receptacle units 310*a* of two adjacent second female receptacle units 300*a* are slidably engaged by the stage and slot.

The technical features of the embodiments described above can be arbitrarily combined. In order to make the description succinct, there is no describing of all possible combinations of the various technical features in the foregoing embodiments. It should be noted that there is no contradiction in the combination of these technical features which should be considered as the scope of the description.

Although the present disclosure is illustrated and described herein with reference to specific embodiments, the present disclosure is not intended to be limited to the details shown. It is to be noted that, various modifications may be made in the details within the scope and range of equivalents of the claims and without departing from the present disclosure. Therefore, the protection scope of the present disclosure shall be subject to the protection scope of the claims.

What is claimed is:

1. A connector, comprising:

a connecting rod comprising a connecting rod body and a connecting rod terminal, wherein the connecting rod body is provided with a first latching groove and a second latching groove, and the connecting rod body is further provided with a plugging hole and an intermediate vent hole, the plugging hole is in communication with the first latching groove and the second latching groove, respectively, the connecting rod terminal extends through the plugging hole, and the intermediate vent hole is in communication with the first latching groove and the second latching groove, respectively;

a first female receptacle comprising a first receptacle body located in the first latching groove and a first conductive terminal, wherein the first receptacle body is provided with a first mounting groove and a first vent hole both in communication with the first latching groove, the first conductive terminal is latched in the first mounting groove, and an end of the connecting rod terminal is located in the first mounting groove and is slidably connected to the first conductive terminal; and a second female receptacle comprising a second receptacle body located in the second latching groove and a second conductive terminal, the second receptacle body is provided with a second mounting groove and a second vent hole both in communication with the second latching groove, the second conductive terminal is latched into the second mounting groove, and another end of the connecting rod terminal is located in the second mounting groove and is slidably connected to the second conductive terminal;

wherein the connecting rod terminal slides in a first direction with respect to the first conductive terminal, and the connecting rod terminal slides in a second direction with respect to the second conductive terminal, the connecting rod terminal further slides in an axial direction of the connecting rod body with respect to the second conductive terminal, the axial direction of the connecting rod body, the first direction, and the second direction are mutually perpendicular to one another.

2. The connector according to claim 1, wherein both ends of the connecting rod terminal are located in the first latching groove and the second latching groove, respectively.

3. The connector according to claim 1, wherein the second receptacle body is provided with a limiting boss, an end of the connecting rod body adjacent to the second receptacle body is provided with a sliding groove, and the limiting boss is slidably received in the sliding groove.

4. The connector according to claim 1, wherein the first conductive terminal is provided with a first latching slot, and the inner wall of the first mounting groove is provided with a first latching rib slidably received in the first latching slot.

5. The connector according to claim 1, wherein the second conductive terminal is provided with a second latching slot, and the inner wall of the second mounting groove is provided with a second latching rib slidably received in the second latching slot.

6. The connector according to claim 1, wherein the connecting rod comprises at least two connecting rod units, each of the at least two connecting rod units comprises a connecting rod body unit and a connecting rod terminal unit, and connecting rod body units of two adjacent connecting rod units are slidably connected to each other.

7. The connector according to claim 6, wherein the first female receptacle comprises at least two first female receptacle units, each of the at least two first female receptacle units comprises a first receptacle unit and a first conductive terminal unit, and the first receptacle units of two adjacent first female receptacle units are slidably connected to each other.

8. The connector according to claim 7, wherein the second female receptacle comprises at least two second female receptacle units, each of the at least two second female receptacle units comprises a second receptacle unit and a second conductive terminal unit, and the second receptacle units of two adjacent second female receptacle units are slidably connected to each other.

9. The connector according to claim 1, wherein the connecting rod terminal comprises a first terminal unit and a second terminal unit electrically coupled to each other, the plugging hole comprises a first plugging hole and a second plugging hole, the first plugging hole is in communication with the first latching groove and the second latching groove, and the second plugging hole is in communication with the first latching groove and the second latching groove, the first terminal unit extends through the first plugging hole, and the second terminal unit extends through the second plugging hole;

each of the at least two first conductive terminals is located in the corresponding first mounting groove, and each of the at least two second conductive terminals is located in the corresponding second mounting groove;

both ends of each of the at least two first terminal units are located in one of the at least two first mounting grooves and one of the at least two second mounting grooves, respectively, and both ends of each of the first terminal units are slidably connected to the corresponding first conductive terminal and the corresponding second conductive terminal, respectively; and both ends of each of the at least two second terminal units are located in another of the at least two first mounting grooves and another of the at least two second mounting grooves, respectively, and both ends of each of the second terminal units are slidably connected to the corresponding first conductive terminal and the corresponding second conductive terminal, respectively.

10. The connector according to claim 9, wherein one end of the first terminal unit is slidably connected to two first conductive terminals, and the other end of the first terminal unit is slidably connected to two second conductive terminals, the first terminal unit and the two first conductive terminals are located in one of the at least two first mounting grooves, and the two second conductive terminals and the second terminal unit are located in one of the at least two second mounting grooves.

11. The connector according to claim 9, wherein one end of the second terminal unit is slidably connected to two first conductive terminals, and the other end of the second terminal unit is slidably connected to two second conductive terminals, the second terminal unit and the two first conductive terminals are located in another one of the at least two first mounting grooves, and the two second conductive terminals and the second terminal unit are located in another of the second mounting grooves.

12. The connector according to claim 9, wherein the first terminal unit abuts against the second terminal unit.

13. The connector according to claim 12, wherein a vent chamber in communication with the first latching groove and the second latching groove is formed between the first terminal unit and the second terminal unit.

14. The connector according to claim 9, wherein the first terminal unit and the second terminal unit are integrally formed.

15. The connector according to claim 9, wherein the first terminal unit is provided with a first elastic piece abutting against an inner wall of the first plugging hole, and the second terminal unit is provided with a second elastic piece abutting against an inner wall of the second plugging hole.

16. The connector according to claim 9, wherein the connecting rod body is further provided with a third vent hole located between the first terminal unit and the second terminal unit, and the third vent hole is in communication with the first latching groove and the second latching groove, respectively.

17. The connector according to claim 16, wherein the first receptacle body is further provided with a fourth vent hole in communication with the third vent hole, and the second receptacle body is further provided with a fifth vent hole in communication with the third vent hole.

18. The connector according to claim 9, wherein each of the first conductive terminals comprises a first body portion and a first bending portion connected to the first body portion, and two first bending portions are bent in a direction closer to each other.

19. The connector according to claim 9, wherein each of the second conductive terminals comprises a second body portion and a second bending portion connected to the second body portion, and two second bending portions are bent in a direction closer to each other.

20. The connector according to claim 9, wherein the first and the second plugging holes are both provided along in the axial direction of the connecting rod body, such that the first and second terminal units are mounted along the axial direction of the connecting rod body.

* * * * *